United States Patent [19]

Konno

[11] Patent Number: 4,854,272

[45] Date of Patent: Aug. 8, 1989

[54] VALVE OPERATING DEVICE FOR INTERNAL COMBUSTION ENGINE

[75] Inventor: Tsuneo Konno, Saitama, Japan

[73] Assignee: Honda Giken Kogyo Kabushiki Kaisha, Tokyo, Japan

[21] Appl. No.: 194,388

[22] Filed: May 16, 1988

[30] Foreign Application Priority Data

May 15, 1987 [JP] Japan ..... 62-119876

[51] Int. Cl.[4] ..... F01L 1/04; F01L 1/26

[52] U.S. Cl. ..... 123/90.17; 123/90.6

[58] Field of Search ..... 123/90.6, 90.16, 90.17, 123/90.18, 90.44

[56] References Cited

U.S. PATENT DOCUMENTS

| | | | |
|---|---|---|---|
| 3,633,554 | 1/1972 | Nakajima et al. | 123/90.18 |
| 4,151,817 | 5/1979 | Mueller | 123/90.17 |
| 4,535,732 | 8/1985 | Nakano et al. . | |
| 4,537,164 | 8/1985 | Ajiki et al. . | |
| 4,537,165 | 8/1985 | Honda et al. . | |
| 4,545,342 | 10/1985 | Nakano et al. . | |
| 4,576,128 | 3/1986 | Kenichi . | |
| 4,587,936 | 5/1986 | Matsuura et al. . | |
| 4,612,884 | 9/1986 | Ajiki et al. . | |
| 4,656,977 | 4/1987 | Nagahiro et al. . | |
| 4,741,297 | 5/1988 | Nagahiro et al. | 123/90.16 |
| 4,777,914 | 10/1988 | Konno | 123/90.16 |
| 4,788,946 | 12/1988 | Inoue et al. | 123/90.17 |
| 4,790,274 | 12/1988 | Inoue et al. | 123/90.17 |
| 4,793,296 | 12/1988 | Inoue et al. | 123/90.17 |

*Primary Examiner*—Willis R. Wolfe
*Assistant Examiner*—M. Macy
*Attorney, Agent, or Firm*—Lyon & Lyon

[57] ABSTRACT

A valve operating device for an internal combustion engine, including a plurality of cams or a camshaft having different cam profiles corresponding to operating conditions of the engine for opening and closing the intake valves according to the operating conditions of the engine. The high-speed cam has a cam lobe which projects from a base-circle portion of the cam by a distance smaller than the distance by which the cam lobe of a low-speed cam projects from the base-circle portion. The cam lobe of the high-speed cam also subtends a larger angle on the base circle of the camshaft than the cam lobe of the low-speed cam.

6 Claims, 2 Drawing Sheets

VALVE OPERATING DEVICE FOR INTERNAL COMBUSTION ENGINE

The present invention relates to a valve operating device for an internal combustion engine, including a camshaft with a plurality of cams having cam profiles for opening and closing intake valves according to the operating conditions of the engine.

In a conventional valve operating device, as disclosed in Japanese Laid-Open Patent Publication No. 59-85408, for example, the degree to which an intake valve is lifted and the time period in which it is open during high-speed operation of the engine are generally larger than those during low-speed operation of the engine.

In the high-speed operation range of the internal combustion engine, it is preferable for the intake valve to be opened earlier and closed later than in the low-speed operation range in order to supply a sufficient amount of air into a combustion chamber. This demand cannot however be met by the aforesaid conventional valve operating device.

According to the present invention, the cam lobe of a high-speed cam corresponding to high-speed operation of the engine projects from a base-circle portion coaxial with the axis of rotation thereof by a distance smaller than the distance by which the cam lobe of a low-speed cam corresponding to low-speed operation of the engine projects from the base-circle portion, and the cam lobe of the high-speed cam subtends a larger angle at the base-circle portion than the cam lobe of the low-speed cam does.

With the above arrangements of this invention, in the high-speed operation range of the engine, the intake valve is opened earlier and closed later than in the low-speed operation range of the engine for supplying a sufficient amount of air. The degree to which the intake valve is lifted can be reduced thereby preventing the intake valve from jumping or bouncing due to its inertia during high-speed operation. In the low-speed operation range, the degree of lifting of the intake valve can be made larger than that in the high-speed operation range to supply a required amount of air.

The invention now will be described in connection with two embodiments of the valve operating mechanism shown in the drawings, wherein.

Figure 1:
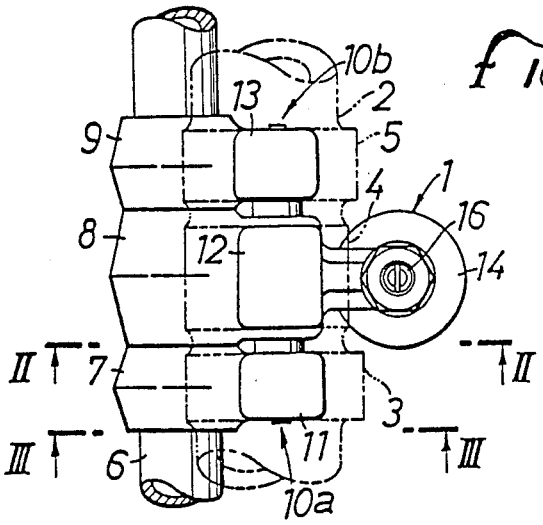
FIG. 1 is a plan view of one embodiment.
Figure 2:
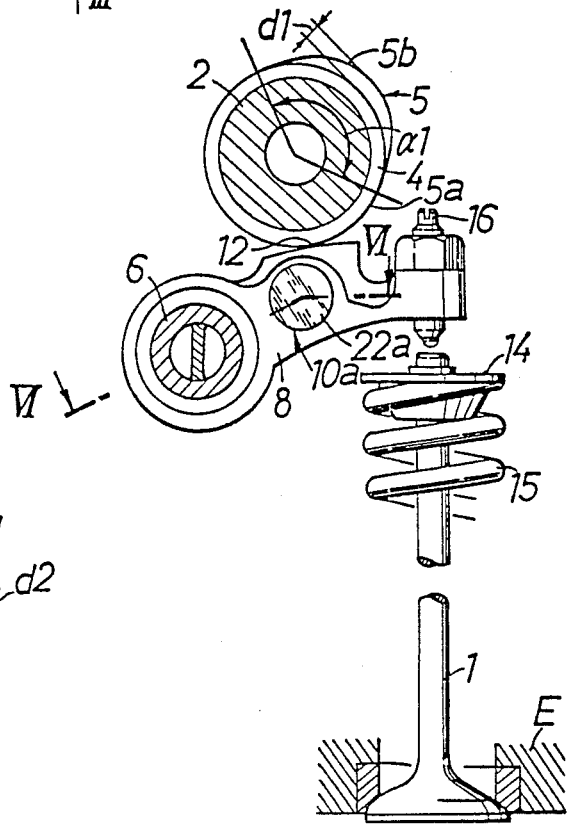
FIG. 2 is a cross-sectional view taken along line II—II of FIG. 1.
Figure 3:
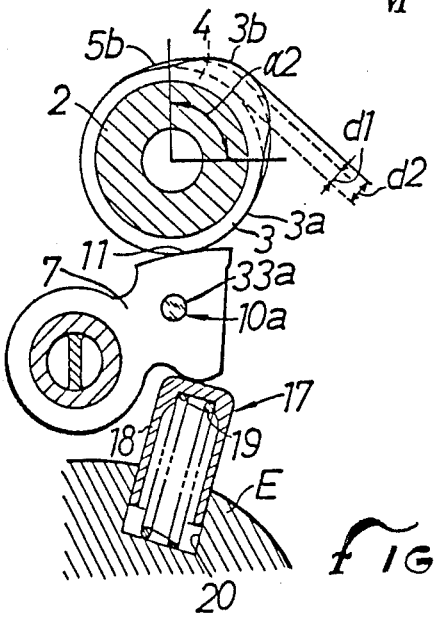
FIG. 3 is a cross-sectional view taken along line III—III of FIG. 1.

The first embodiment of the present invention will hereinafter be described with reference to FIGS. 1 through 5 of the drawings which illustrate the valve operating mechanism for a single intake valve 1 for one cylinder of an engine but it will be understood that there may be multiple cylinders in the engine and multiple intake valves for each cylinder. In FIGS. 1, 2 and 3, an intake valve 1 disposed in an engine body E is opened and closed by valve operating mechanism including a low-speed cam 3, a raised portion 4, and a high-speed cam 5 which are integrally formed on a camshaft 2 rotatable by the crankshaft of the engine at a speed ratio of ½ with respect to the speed of rotation of the engine, by first, second and third rocker arms 7, 8, 9, respectively, pivotally supported on a rocker shaft 6 extending parallel to the camshaft 2, and by selective coupling mechanisms 10*a*, 10*b* disposed between the first and second rocker arms 7, 8 and the second and third rocker arms 8, 9, respectively.

The camshaft 2 is rotatably disposed above the engine body E. The low-speed cam 3, the raised portion 4, and the high-speed cam 5 are axially successively arranged in adjacent relation and integrally formed with the camshaft 2. The low-speed cam 3 has a cam profile corresponding to low-speed operation of the engine and includes a base circle portion 3*a* coaxial with the camshaft 2 and a cam lobe 3*b* projecting radially outwardly from the base circle portion 3*a*. The raised portion 4 is of a circular shape coaxial with the camshaft 2 and of the substantially the same diameter as base circle portion 3*a*. The high-speed cam 5 has a cam profile corresponding to a high-speed operation of the engine and includes a base circle portion 5*a* coaxial with the camshaft 2 and a cam lobe 5*b* projecting radially outwardly from the base circle portion 5*a*. The cam lobe 5*b* of the high-speed cam 5 subtends a larger angle $\alpha 1$ from the center of the camshaft 2 along the base circle portion 5*a* than the cam lobe 3*b* of the low-speed cam 3 which subtends an angle $\alpha 2$ from the center of the camshaft 2 along the circumference of the base circle portion 3*a*. The distance d1 by which the cam lobe 5*b* of the high-speed cam 5 projects from the base circle portion 5*a* is smaller than the distance d2 by which the cam lobe 3*b* of the low-speed cam 3 projects from the base circle portion 3*a*.

The rocker shaft 6 is fixedly positioned below the camshaft 2. The first rocker arm 7 has on its upper surface a cam slipper 11 held in slidable contact with the low-speed cam 3, the second rocker arm 8 has on its upper surface a cam slipper 12 held in slidable contact with the raised portion 4, and the third rocker arm 9 has on its upper surface a cam slipper 13 held in slidable contact with the high-speed cam 5. The rocker arms 7, 8 and 9 are pivotally supported on the rocker shaft 6 in axially adjacent relation.

The intake valve 1 is operatively associated with the second rocker arm 8. A flange 14 is attached to the upper end of the intake valve 1. The intake valve 1 is normally urged in a closing direction, i.e., upwardly, by a valve spring 15 disposed between the flange 14 and the engine body E. A tappet screw 16 is adjustably threaded in the distal end of the second rocker arm 8 in abutting engagement with the upper end of the intake valve 1 (a gap is shown for clarity of illustration only).

The first rocker arm 7 is normally urged resiliently in a direction to cause the cam slipper 11 to slidably contact the low-speed cam 3 by resilient urging means 17 disposed between the first rocker arm 7 and the engine body E. The resilient urging means 17 comprises a cylindrical bottomed lifter 18 with its closed end held against the lower surface of the first rocker arm 7, and a lifter spring 19 disposed between the lifter 18 and the engine body E. The lifter 18 is slidably fitted in a bottomed hole 20 defined in the engine body E.

Resilient urging means (not shown) similar to the resilient urging means 17 is also disposed between the third rocker arm 9 and the engine body E for normally urging the third rocker arm 9 upwardly to hold the cam slipper 13 slidably against the high-speed cam 5 at all times.

Figure 4:
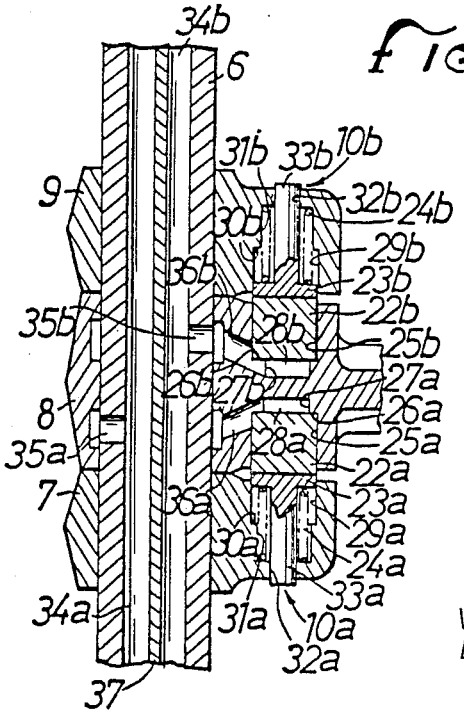
FIG. 4 is a cross-sectional view taken along line IV—IV of FIG. 2.
Figure 5:
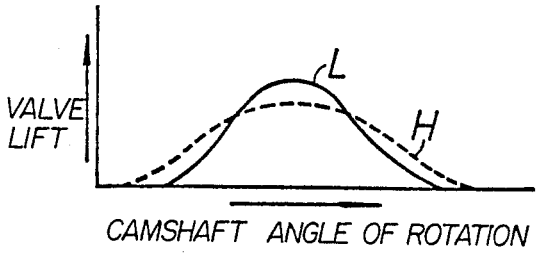
FIG. 5 is a diagram showing the valve opening profiles of an intake valve operated by the valve operating mechanism of this invention.

As shown in FIG. 4, the selective coupling mechanism 10*a* comprises a piston 22*a* movable between a position in which the first and second rocker arms 7, 8 are connected and a position in which they are disconnected, a stopper 23*a* for limiting the movement of the piston 22*a*, and a return spring 24*a* for urging the piston 22*a* in a direction to disconnect the rocker arms 7, 8.

The second rocker arm 8 has a first bottomed guide hole 25*a* opening toward the first rocker arm 7 and parallel to the rocker shaft 6, with a smaller-diameter hole 27*a* being defined at the closed end of the first guide hole 25*a* with a step 26*a* therebetween. The piston 22*a* is slidably fitted in the first guide hole 25*a*, with a hydraulic chamber 28*a* being defined between the piston 22*a* and the closed end of the smaller-diameter hole 27*a*.

The first rocker arm 7 has a second bottomed guide hole 29*a* opening toward the second rocker arm 8 and parallel to the rocker shaft 6 for registration with the first guide hole 25*a*. The disc-shaped stopper 23*a* is slidably fitted in the second guide hole 29*a*. A smaller-diameter hole 31*a* is defined at the closed end of the second guide hole 29*a* with a limiting step 30*a* therebetween. An insertion hole 32*a* is also defined at the closed end of the smaller-diameter hole 31*a* coaxially therewith. A guide rod 33*a* coaxial and integral with the stopper 23*a* extends through the insertion hole 32*a*. The return coil spring 24*a* is disposed between the stopper 23*a* and the closed end of the smaller-diameter hole 31*a* around the guide rod 33*a*.

The piston 22*a* has an axial length such that when one end thereof abuts against the step 26*a*, the other end thereof is positioned between the first and second rocker arms 7, 8, and when the piston 22*a* is urged by hydraulic pressure to enter the second guide hole 29*a* to the extent that the stopper 23*a* abuts against the limiting step 30*a*, said one end of the piston 22*a* remains positioned in the first guide hole 25*a*.

The rocker shaft 6 has an interior hollow space divided into two oil passages 34*a*, 34*b* by an axially extending partition 37. The oil passages 34*a*, 34*b* are selectively supplied with hydraulic pressure from a hydraulic pressure supply source (not shown).

The rocker shaft 6 has defined therein a communication hole 35*a* in communication with the oil passage 34*a* and a communication hole 35*b* in communication with the oil passage 34*b*. The communication holes 35*a*, 35*b* are axially spaced from each other. The second rocker arm 8 has defined therein a communication passage 36*a* and a communication passage 36*b*. The communication passage 36*a* and the communication hole 35*a* are held in communication with each other at all times, irrespective of how the second rocker arm 8 may be angularly moved, by a circumferential groove (unnumbered) and the communication passage 36*b* and the communication hole 35*b* are held in communication with each other at all times, irrespective of how the second rocker arm 8 may be angularly moved, by a separate circumferential groove (unnumbered). The communication passage 36*a* communicates with the hydraulic chamber 28*a*.

The selective coupling mechanism 10*b* disposed between the second and third rocker arms 8, 9 is basically of the same construction as that of the selective coupling mechanism 10*a*. Those components of the selective coupling mechanism 10*b* which are identical to those of the selective coupling mechanism 10*a* are denoted by identical reference numerals with a suffix b, and will not be described in detail. The hydraulic chamber 28*b* of the selective coupling mechanisms 10*b* communicates with the oil passage 34*b* through the communication passage 36*b* and the communication hole 35*b*.

Operation of the above-described embodiment now will be described. During low-speed operation of the engine, hydraulic pressure is supplied to the oil passage 34*a* whereas the other oil passage 34*b* is released of any hydraulic pressure. Therefore, the piston 22*a* of the selective coupling mechanism 10*a* is moved toward the first rocker arm 7 against the resiliency of the return spring 24*a* and into the second guide hole 29*a* to connect the first and second rocker arms 7, 8. In the other selective coupling mechanism 10*b*, the mutually sliding surfaces of the piston 22*b* and the stopper 23*b* are positioned between the second and third rocker arms 8, 9, which are thus disconnected from each other. Therefore, the second rocker arm 8 swings to open and close the intake valve 1 at the timing and lift according to the profile of the low-speed cam 3, as indicated by the solid line L in FIG. 5.

During high-speed operation of the engine, hydraulic pressure is supplied to the oil passage 34*b* whereas the oil passage 34*a* is released of any hydraulic pressure. In the selective coupling mechanism 10*a*, the mutually sliding surfaces of the piston 22*a* and the stopper 23*a* are positioned between the first and second rocker arms 7, 8, which are thus disconnected from each other. The piston 22*b* of the selective coupling mechanism 10*b* is moved toward and into guide hole 29*b* of the third rocker arm 9 against the resiliency of the return spring 24*b* to connect the second and third rocker arms 8, 9. Accordingly, the second rocker arm 8 swings to open and close the intake valve 1 at the timing and lift according to the profile of the high-speed cam 5, as indicated by the dotted line H in FIG. 5.

Since the angle $\alpha 1$ subtended at the basic circle of the camshaft 2 by the cam lobe 5*b* of the high-speed cam 5 is larger than the angle $\alpha 2$ subtended at the basic circle of the camshaft 2 by the cam lobe 3*b* of the low-speed cam 3, the intake valve 1 is opened earlier during high-speed operation than during low-speed operation and is closed later during high-speed operation than during low-speed operation. Consequently, during high-speed operation, the intake valve 1 remains open for a relatively long time, so that a sufficient amount of air can be supplied into the combustion chamber. Moreover, since the distance which the intake valve 1 is lifted during high-speed operation is relatively small, the intake valve 1 is prevented from jumping or bouncing due to its inertia upon high-speed operation. During low-speed operation, the period of time in which the intake valve 1 is open is relatively short. However, since the distance which the intake valve 1 is lifted is larger during low-speed operation than during high-speed operation, a required amount of air can be supplied.

It is preferable that the cams 3, 5 be dimensioned to substantially equalize the areas surrounded by the lift curves H, L for the intake valve 1.

Figure 6:
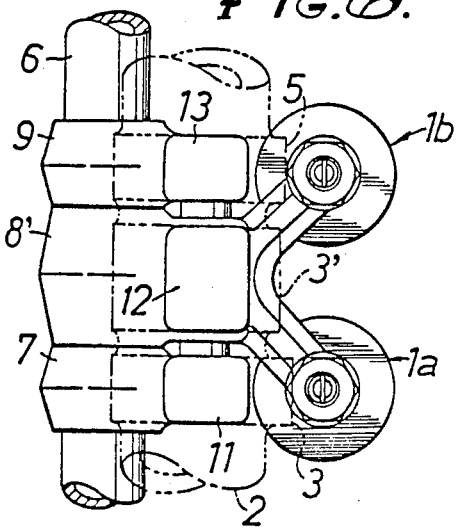
FIG. 6 is a plan view similar to FIG. 1 illustrating another embodiment of the present invention.
Figure 7:
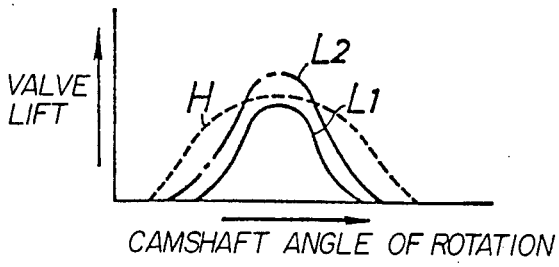
FIG. 7 is a diagram showing the valve opening profiles of the intake valves of the embodiment of FIG. 6.

FIGS. 6 and 7 show another embodiment of the present invention. Those parts which are identical to those of the previous embodiment are denoted by identical reference numerals. First, second, and third rocker arms 7, 8', 9 are pivotally supported on a rocker shaft 6, with a pair of intake valves 1a, 1b being operatively associated with the second rocker arm 8'. Integrally formed with the camshaft 2 are a low-speed cam 3 held in slidable contact with the first rocker arm 7, and a very low-speed cam 3' held in slidable contact with the second rocker arm 8', and a high-speed cam 5 held in slidable contact with the third rocker arm 9.

The rocker arms 7, 8', 9 have selective coupling mechanisms capable of selecting one of three conditions, namely, a condition in which all of the rocker arms 7, 8', 9 are disconnected, a condition in which the first and second rocker arms 7, 8' are connected, and a condition in which the second and third rocker arms 8', 9 are connected. Thus, the three selective operating conditions are (1) a condition in which the intake valves 1a, 1b are opened and closed by the very low-speed cam 3', (2) a condition in which the intake valves 1a, 1b are opened and closed by the low-speed cam 3, and (3) a condition in which the intake valves 1a, 1b are opened and closed by the high-speed cam 5.

The very low-speed cam 3' is of a shape to provide a valve opening profile as indicated by the solid line L1 in FIG. 7. The low-speed cam 3 is of a shape to provide a valve opening profile as indicated by the dot-and-dash line L2 in FIG. 7. The high-speed cam 5 is of a shape to provide a valve opening profile as indicated by the dotted line H in FIG. 7.

In this embodiment of FIGS. 6 and 7, the intake valves 1a, 1b are opened earlier and closed later during high-speed operation to supply a sufficient amount of air. During low-speed operation in which the low-speed cam 3 operates, the distance which the intake valves 1a, 1b are lifted is relatively large to supply a required amount of air. In very low-speed operation by cam 3', the valve lift and duration are less to enhance the air flow rate and turbulence for maintaining a good air-fuel mixture.

The present invention is not limited to the valve operating device in which the rocker arms are selectively connected and disconnected by the pistons, but also to a valve operating device in which rocker arms are movable axially of a camshaft into slidable contact with different cams or any other mechanism for selectively operating intake valves by different cam profiles.

With the present invention, as described above, a high-speed cam corresponding to high-speed operation of an engine has a cam lobe which projects from a base circle portion coaxial with the axis of rotation of the high-speed cam by a distance smaller than the distance which the cam lobe of a low-speed cam corresponding to low-speed operation of the engine projects from the base-circle portion, and the cam lobe of the high-speed cam subtends a larger angle on the camshaft than the cam lobe of the low-speed cam does. During high-speed operation of the engine, an intake valve is opened earlier and closed later than during low-speed operation to supply a sufficient amount of air, and the intake valve is prevented from jumping or bouncing due to its inertia upon high-speed operation. During low-speed operation, the distance which the intake valve is lifted is increased to supply a required amount of air.

What is claimed:

1. A valve operating device for an internal combustion engine, including a plurality of cams having cam profiles corresponding to operating conditions of the engine and disposed on a camshaft for opening and closing an intake valve according to the operating conditions of the engine, comprising, a cam lobe of a high-speed cam on the camshaft for high-speed operation of the engine projecting from a base-circle portion coaxial with the axis of rotation of the camshaft by a distance smaller than a distance by which a cam lobe of a low-speed cam on the camshaft for low-speed operation of the engine projects from a base-circle portion, and said cam lobe of the high-speed cam subtending a larger angle along the circumference of the base portion of the camshaft than an angle on the base-circle portion subtended by the cam lobe of the low-speed cam.

2. The valve operating device of claim 1, wherein a pair of intake valves are operated by each high-speed cam and low-speed cam.

3. The valve operating device of claim 1, wherein a cam lobe of a very low-speed cam is provided having a cam profile projecting from a base circle portion less than the cam lobe of the low-speed cam.

4. The valve operating device of claim 3, wherein the very low-speed cam is provided with a cam lobe having a cam profile subtending a smaller angle on the base circle portion than the angle subtended by the cam lobe of the low-speed cam.

5. The valve operating device of claim 1, wherein a very low-speed cam is provided with a cam lobe having a cam profile subtending a smaller angle on the base circle portion than the angle subtended by the cam lobe of the low-speed cam.

6. A valve operating device for at least one intake valve of an internal combustion engine having a camshaft with a plurality of cams and a mechanism for selectively operating the intake valve by each cam, comprising, a low-speed cam having a cam lobe of a profile for low-speed engine operation, and a high-speed cam having a cam lobe for high-speed engine operation which cam lobe projects outwardly a smaller distance and extends circumferentially larger distance than the cam lobe of the low-speed cam.

* * * * *